United States Patent [19]

White

[11] Patent Number: 4,699,315

[45] Date of Patent: Oct. 13, 1987

[54] APPARATUS FOR RECOVERING CHIMNEY HEAT

[76] Inventor: E. R. White, 6614 E. Gold Dust Ave., Scottsdale, Ariz. 85254

[21] Appl. No.: 235,008

[22] Filed: Feb. 17, 1981

[51] Int. Cl.[4] ..... F24D 3/00; F24B 9/04

[52] U.S. Cl. ..... 237/8 R; 237/51; 126/132; 165/901

[58] Field of Search ..... 165/DIG. 2, 18; 237/55, 237/80, 51, 8 R; 126/400, 427, 132, 133

[56] References Cited

U.S. PATENT DOCUMENTS

| | | | |
|---|---|---|---|
| 2,355,495 | 8/1944 | Zier, Jr. | 237/55 |
| 3,812,872 | 5/1974 | Block et al. | 237/80 |
| 4,046,320 | 9/1977 | Johnson et al. | 237/51 |
| 4,050,626 | 9/1977 | Awalt, Jr. | 126/400 |
| 4,143,816 | 3/1979 | Skadeland | 165/DIG. 2 |
| 4,153,199 | 5/1979 | Ellmer | 237/8 R |
| 4,173,994 | 11/1979 | Hiser | 126/427 |
| 4,191,166 | 3/1980 | Saarem et al. | 126/420 |
| 4,246,887 | 1/1981 | Christiansen | 126/427 |
| 4,258,878 | 3/1981 | Van Pachtenbeke | 165/DIG. 2 |
| 4,261,332 | 4/1981 | Stewart | 126/420 |
| 4,286,975 | 9/1981 | Whiteley | 165/184 |
| 4,334,518 | 6/1982 | Ort | 126/132 |
| 4,335,703 | 6/1982 | Klank | 237/51 |
| 4,336,905 | 6/1982 | Langs | 237/51 |
| 4,449,571 | 5/1984 | Kramert | 122/20 B |
| 4,462,542 | 7/1984 | Person | 237/8 R |

*Primary Examiner*—Albert W. Davis, Jr.
*Assistant Examiner*—John K. Ford
*Attorney, Agent, or Firm*—Harry M. Weiss & Associates

[57] ABSTRACT

This disclosure relates to a heating system for a building having a chimney, which heating system incorporates a heat collecting recovery unit set atop the chimney, an underground reservoir, a circulating pump, and an exchanger disposed to reject heat to the conditioned space within the building, to serve in combination to heat the building with energy which had heretofore been wasted, so that the energy consumption rate required for heating can be reduced.

2 Claims, 2 Drawing Figures

APPARATUS FOR RECOVERING CHIMNEY HEAT

BACKGROUND OF THE INVENTION

1. Field of the Invention

This invention relates to energy saving devices, and more particularly to a system for recovering waste heat from flue gasses leaving a chimney, for storing the recovered heat in a reservoir, and further for controllably rejecting the recovered heat to the interior of the building. It is anticipated that the primary application for the invention disclosed herein will be as a supplemental residential heating unit.

2. Description of the Prior Art

In the past, the climbing cost of energy has presented a problem, which problem has been particularly acute for such essential applications as domestic heating. Often, homes were provided with fireplaces, but the use of the conventional fireplace typically represented a net heat loss, in that heated air from the conditioned space of the building was utilized for combustion and subsequently escaped up the chimney. While heated air was escaping up the chimney, unheated make-up air correspondingly migrated into the conditioned space.

Various attempts have been made to develop a workable low cost heat recovery system to gainfully utilize the heat which normally had escaped from the chimney. In U.S. Pat. No. 2,355,495 to Zier on Aug. 8, 1944, a system is disclosed which jackets the chimney and combustion source to recover heat. However, the disclosed apparatus is not readily adaptable to an existing fireplace and chimney, in that extensive structural modifications would be required for installation.

In U.S. Pat. No. 4,158,439 to Gibbs on June 10, 1979, a waste heat collector is disclosed which includes elongated ducts to be suspended within a chimney to effect the heat recovery with a working fluid circulating through the ducts. However, the specification therein acknowledges a problem in that where a low cost working fluid (e.g. water) is utilized a possible freeze-up of the working fluid is possible when the combustion source is not in operation. The recommended solution is to utilize a more expensive anti-freeze liquid as the working fluid.

In U.S. Pat. No. 4,160,524 to Stiber on July 10, 1979, another waste heat recovery system is disclosed, but as in the Zier U.S. Pat. No. 2,355,495, requires extensive, expensive structural modification to the building where the system is to be installed on an existing fireplace.

A need continued to exist for a waste heat recovery system readily adaptable to an existing fireplace equipped structure, which system required only minimal structural modifications to the standing building for installation, which system was protected against a freeze-up of the working fluid within the system, and which system was selectively operable to store a quantity of heat for subsequent transfer to the condition space of the structure.

SUMMARY OF THE INVENTION

In accordance with one embodiment of this invention, it is an object to provide a freeze-up protected waste heat recovery system for a building having an existing fireplace and chimney.

It is another object to provide a waste heat recovery system for a building having an existing fireplace and chimney which system can recover and store heat, which can recover and distribute heat, and which can distribute stored heat.

It is still another object to provide a waste heat recovery system for a building having an existing fireplace and chimney which system can be installed with a minimum of structural modifications to the existing structure.

DESCRIPTION OF THE PREFERRED EMBODIMENTS

In accordance with one embodiment of this invention, a heating system for a building having a conditioned space, a combustion source and a chimney is disclosed, comprising: a fluid; recovery means coupled to an outlet of the chimney for transferring a first quantity of heat from exhaust rising from the chimney to the fluid; storage means for storing a quantity of the fluid; exchanger means for transferring a second quantity of heat from the fluid to the conditioned space; and pump means for selectively circulating the fluid through the system.

In accordance with one embodiment of this invention, a method for heating a conditioned space in a building having a combustion source and a chimney is disclosed, comprising the steps of: capping the chimney with a heat exchanger; circulating a fluid through the heat exchanger to absorb heat; and rejecting the heat to the conditioned space.

The foregoing and other objects, features and advantages will be apparent from the following, more particular, description of the preferred embodiments of the invention, as illustrated in the accompanying drawings.

THE SPECIFICATION

Figure 1:
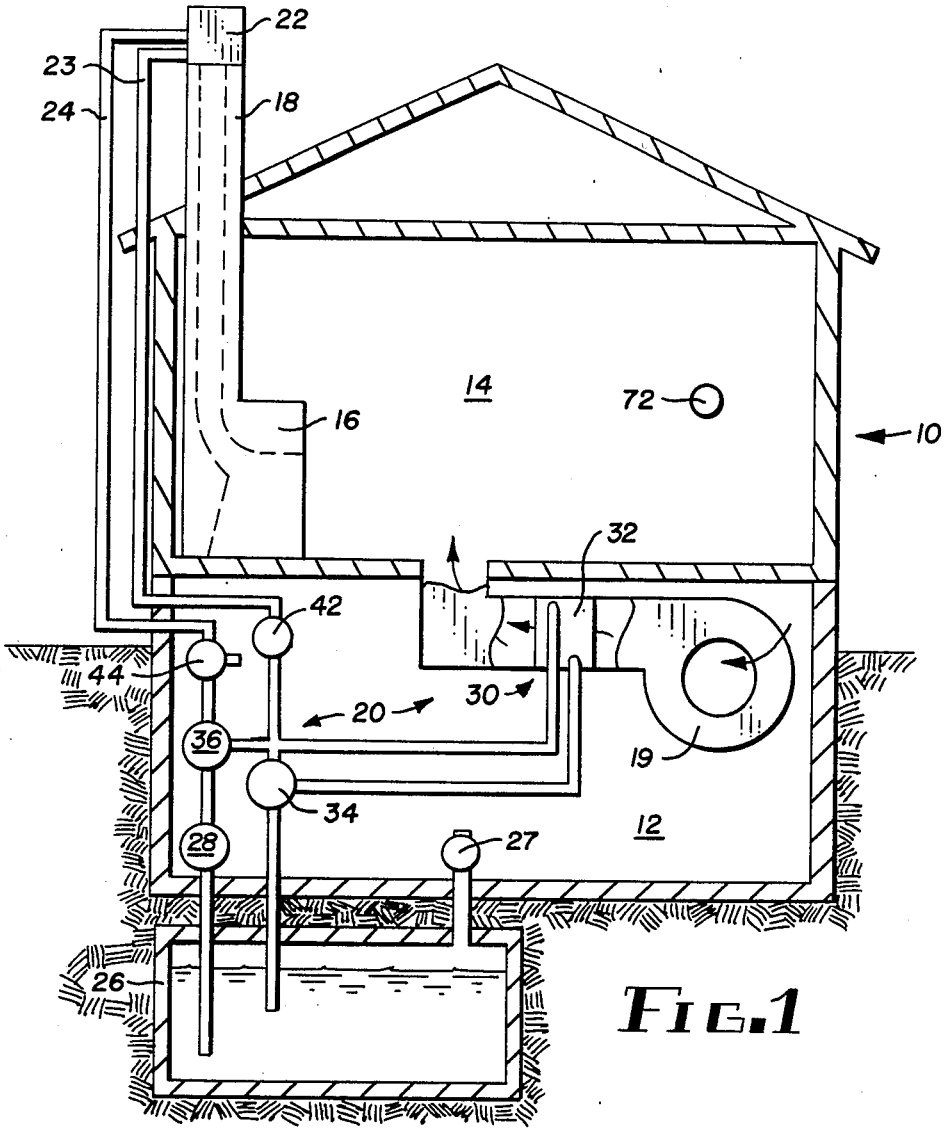
FIG. 1 is a sectional view of an existing building having the herein disclosed waste heat recovery system installed therein.

Referring to FIG. 1, a building 10 is shown provided with a basement 12, a conditioned space 14 and a fireplace 16. The fireplace 16 is vented to the atmosphere through a chimney 18. The building 10 also has a forced air heating system 19. A waste heat recovery system, shown generally by reference number 20, is provided to selectively heat the conditioned space 14 with heat which would otherwise be wasted by the escape of the exhaust from the fireplace to the atmosphere through the chimney 18.

The heating system 20 includes a recovery exchanger 22, which caps the chimney 18 and is the final outlet to the atmosphere for the products of combustion from the fireplace 16. The recovery exchanger 22 is for transferring heat from the products of combustion to a fluid which is circulated through the recovery exchanger 22. The working fluid enters the recovery exchanger 22 through an inlet line 24, and a return line 23 couples the recovery exchanger 22 to a storage vessel 26. While the vessel 26 is shown inset into the earth to reduce heat losses, an insulated version of the vessel could be readily installed in the basement 12. A vent 27 prevents accumulation of pressure in the vessel 26. Thus as heated fluid is added to the vessel 26, a reservoir of heat can be accumulated. A pump 28 is situated to deliver fluid from the vessel 26 to the other portions of the system 20, including a recovery apparatus as shown generally by reference number 30. The recovery apparatus 30 is for transferring a second quantity of heat to the conditioned space 14. The recovery apparatus 30 is shown as an exchanger coil 32 mounted in a duct of the forced air heating system 19. Alternatively, the recovery apparatus 30 can be any of a variety of other well known devices, such as baseboard heaters.

The heating system 20 has four modes of operation, including an off state, a full operation state, a collect only state and a reject only state. When in the full operation state, an exchanger valve 36 directs the flow to the recovery exchanger 22 to absorb additional heat from the fireplace exhaust passing through the chimney 18, and a rejection valve 34 diverts the flow of fluid through the exchanger coil 32 to heat the conditioned space 14. The heating system 20 is also operable in a collect only mode, wherein the rejection valve 34 shunts the flow past the recovery apparatus 30 to vessel 26 so that the only heat transfer occurs between the exhaust leaving the chimney 18 and the fluid as a result of the continued operation of the recovery exchanger apparatus 22. The heating system 20 is further operable in a reject only mode, wherein the rejection valve 34 directs flow thrugh the recovery apparatus 30 while the exchanger valve 36 is operated to bypass the flow around the recovery exchanger 22, so that the only heat transfer is the heat rejected to the conditioned space 14 by the exchanger coil 32.

To provide the recovery exchanger 22 with protection against both freeze-up of the fluid when the combustion in the fireplace 16 ceases, and against a boiling of the fluid within the recovery exchanger 22 when a fire is continued in the fireplace 16 even after the pump 28 is turned off, for example in response to the heat storage capacity of the vessel 26 having been reached, a siphon apparatus is provided. The siphon apparatus has a one way valve 42 mounted in the return line 23 from the recovoery exchanger 22, and also has a self-sealing vent 44 positioned immediately adjacent to the exchanger valve 36, so that when the pump 28 is stopped, air freely enters through the vent 44. Since the level of fluid in the vessel 26 is lower than the vent 4, the fluid in the recovery exchanger 22, and in the pipes 23, 24 leading to and from the recovery exchanger 22, is siphoned back into the vessel 26 through the valves 42 and 36 and the pump 28 when the system 20 is in the full operation state, and the rejection state. When the system 20 is in the collect state, the fluid is siphoned into the vessel 26 via the valve 34.

Figure 2:
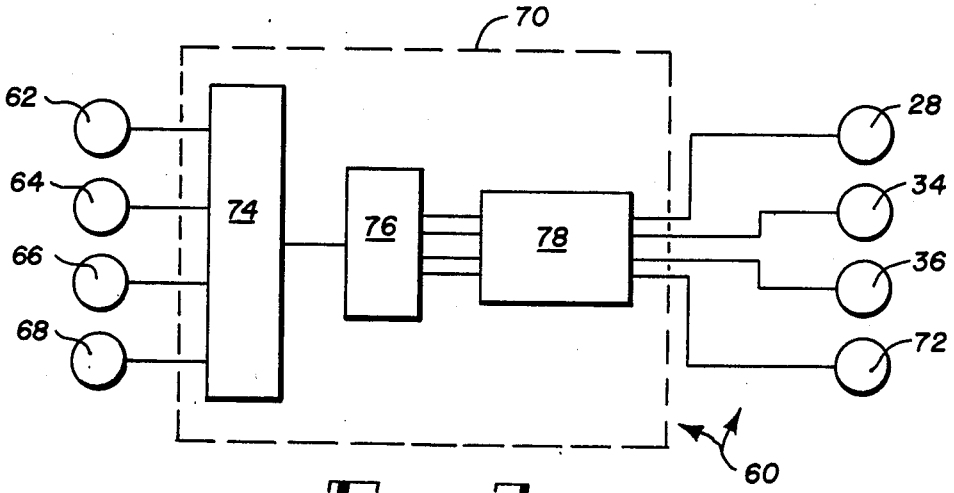
FIG. 2 is a block diagram outlining the functional features of the control system of the waste heat recovery system disclosed herein.

Referring also to FIG. 2, a block diagram of a control system of the heating system 20 is shown generally by reference number 60. As inputs, the control system monitors at least the current available temperature in the chimney 18 with an exhaust temperature sensor 62, the current temperature of the fluid in the vessel 26 with a vessel temperature sensor 64, and the current temperatures within the conditioned space 14 with an ambient temperature sensor 66. A fan operation sensor 66 provides an input signal when the fan of the forced air system 19 is in operation, indicating that heat can be constructively added through the exchanger coil to substitute for at least a portion, if not all, of the energy input required from the primary heating system 19.

The inputs are coupled to a logic network 70. The logic network 70 selectively provides various combinations of output signals, including signals to the pump 28, to the rejection valve 34, to the exchanger valve 36, and to a low temperature indicator light 72, which gives notice to persons in the building 10 when the temperature of the fluid in the vessel 26 has fallen low enough that a fire could be advantageously built in the fireplace 16 to restore the heat content and temperature of the fluid in the vessel 26.

While various combinations of devices, such as thermally actuated switches and relays, can effectively function as the control system 60, the embodiment of the invention as shown utilizes a microprocessor based control system. In the microprocessor based system, the temperature sensors 62, 64, 66 are thermocouple circuits effecting a variable voltage signal corresponding to the respective temperatures. The fan operation sensor 68 is simply a tap on the motor drive circuit of the fan motor of the forced air system 19. A data selector 74 serially polls the respective sensors 62, 64, 66, analog/digital converter 76 receives the output from the data selector 74 and digitizes the particular signals, and a mcroprocessor 78 then compares and processes the the incoming signals in precisely controlled synchronization in accord with a program to determine which if any of the operable elements including the pump 28, the rejection valve 34, the exchanger valve 36 and the indicator light 72, should be driven.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A system for recovering conventional chimney heat in a building having a conditioned space, a conventional fireplace for housing a source of combustion, a conventional fireplace chimney for passing the hot waste gases and combustion products from the combustion source in the fireplace to the atmosphere through the top of the chimney outside the building, comprising:

a heat exchange liquid;

heat recovery means operatively coupled at the top of the fireplace chimney outside the building and capping the same for transferring a first quantity of heat from the hot waste gases and products of combustion exiting the top of the chimney to the heat exchange liquid and for permitting said hot waste gases and products of combustion to exit directly upwardly from the top of said chimney through said heat recovery means;

storage means for storing a quantity of said heat exchange liquid substantially located therebelow a basement of said building having ambient means extending therefrom for preventing accumulation of pressure in said storage means;

heat exchanger means for transferring said quantity of heat from said heat exchange liquid into said conditioned space;

first pipe means operatively coupled between said storage means and said heat recovery means having a pump for supplying said heat exchange liquid from said storage means to said heat recovery means for heating same, said first pipe means substantially located outside said building;

second pipe means operatively coupled between said heat recovery means and said storage means for returning said heat exchange fluid and said first quantity of heat absorbed therein from said heat recovery means to said storage means, said second pipe means substantially located outside said building;

third pipe means operatively coupled between said second pipe means and said heat exchanger means for returning the cooler heat exchange liquid from said heat exchanger means to said storage means;

fourth pipe means operatively coupled between said first pipe means, said second pipe means and said heat exchanger means for supplying said heat exchange liquid from said heat recovery means and said storage means to said heat exchanger means;

first valve means opertively coupled to said first and fourth pipe means and having a first operative position for routing said heat exchange liquid from said storage means through said first pipe means to said heat recovery means and blocking flow of heat exchange liquid through said fourth pipe means and a second operative position for blocking flow of heat exchange liquid through said first pipe means to said recovery means and routing flow through said fourth pipe means to said heat exchanger means for supplying reserve heat thereto and second valve means operatively coupled to said second and third pipe means and having a first operative position blocking the direct passage of said heat transfer liquid from said heat recovery means to said storage means thereby routing said heat exchange liquid through said fourth pipe means to said heat exchanger means, and opening communication through said third pipe means to said storage means, and a second operative position directly routing said heat exchange fluid from said heat recovery means to said storage means.

2. The system of claim 1, further including indicator means for providing a visual indicia corresponding to the temperature of said heat exchange liquid in said storage means so that a person in said conditioned space can perceive when said combustion source should be fired to heat said exchange liquid in said heat recovery means.

* * * * *